United States Patent [19]

Braün et al.

[11] 4,407,546

[45] Oct. 4, 1983

[54] MINING PLANER WITH PIVOTAL TOOL HOLDER

[75] Inventors: Ernst Braün; Gert Braün, both of Essen-Heisingen, Fed. Rep. of Germany

[73] Assignee: Halbach & Braun, Fed. Rep. of Germany

[21] Appl. No.: 246,017

[22] Filed: Mar. 20, 1981

[30] Foreign Application Priority Data

Mar. 22, 1980 [DE] Fed. Rep. of Germany ..... 3011100

[51] Int. Cl.[3] ..... E21C 27/35

[52] U.S. Cl. ..... 299/34

[58] Field of Search ..... 299/32, 34

[56] References Cited

U.S. PATENT DOCUMENTS

| | | | |
|---|---|---|---|
| 3,361,479 | 1/1968 | Lobbe | 299/34 |
| 3,494,668 | 2/1970 | Grebe | 299/34 X |
| 4,035,025 | 7/1977 | Hermann et al. | 299/34 |

*Primary Examiner*—Ernest R. Purser

*Attorney, Agent, or Firm*—McGlew and Tuttle

[57] ABSTRACT

A planer assembly is disclosed for winning minerals from a mineral face comprising, a planer guide member, at least two planers slidably engaged on the guide member for movement in a travel direction along the face, a hinge interconnecting the two planers for transferring rotational moment applied to the planers and a planer tool holder mounted on each planer which carries a tool. The planer tool holder is positionable at an angle to make a cut of a selected depth with the depth increasing from planer to planer in a direction opposite the travel direction.

28 Claims, 7 Drawing Figures

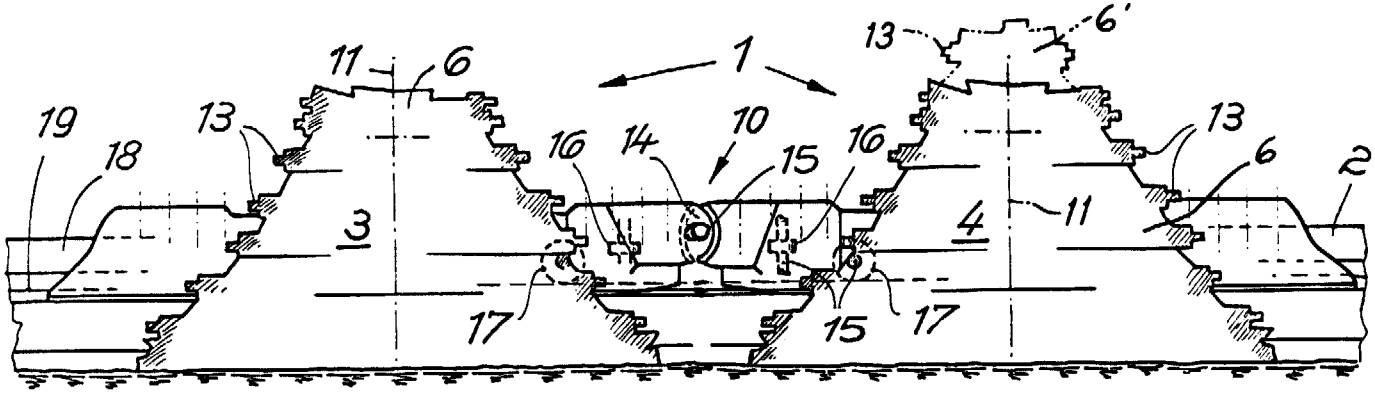
FIG. 1
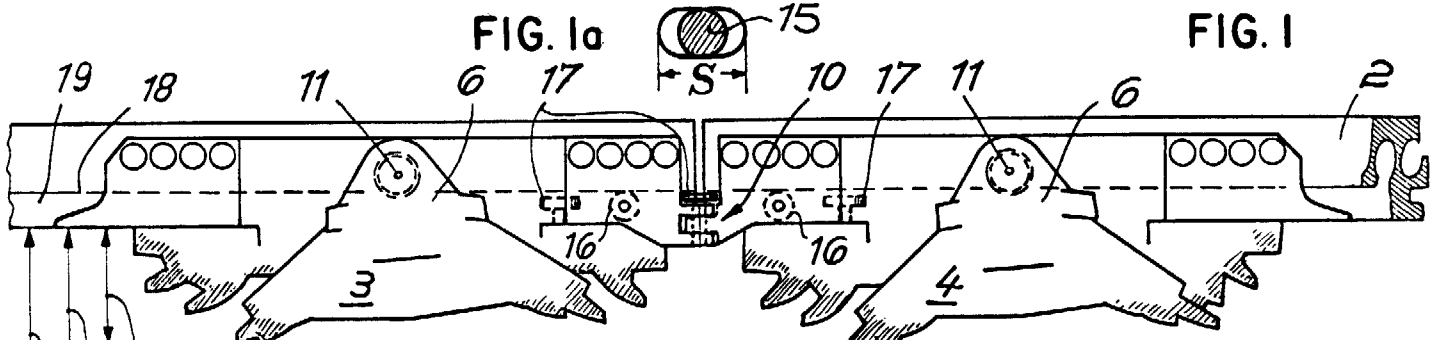
FIG. 2
FIG. 1a
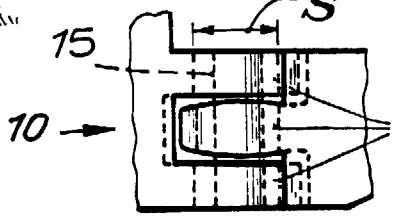
FIG. 2a

MINING PLANER WITH PIVOTAL TOOL HOLDER

FIELD AND BACKGROUND OF THE INVENTION

The present invention relates in general to mining equipment and, in particular to a new and useful mineral winning assembly which utilizes a plurality of planers connected to each other in an articulated chain.

With a predetermined traveling rate, the performance of a coal planer substantially depends on the overall height of the planing mechanism and the depth of cut of the planing tools. Both overall height and depth of cut in turn are predetermined by the planer guide. That is, the planer guide must be capable of taking up the forces necessary for pressing the planing mechanism against the winning face and also the tilting moments resulting therefrom. On the other hand, the overall height of the planing mechanism is limited by the thickness of the worked seam. Therefore, as a rule the output cannot be increased by merely augmenting the overall height and depth of cut.

SUMMARY OF THE INVENTION

The present invention is directed to a planer assembly of the above mentioned kind which is capable of increased performance, even in thin seams.

An object of the present invention is thus to provide a planer assembly for winning minerals from a winning face, particularly a coal planer assembly for underground mining, comprising a planer mechanism including at least one tool holder, a planer chain running in a planer guide to which the planer mechanism is connected, a planer mechanism comprising a train of two or more individual planers which, with interposed hinge connections to compensate for occurring moments, are rigidly connected to each other so that the tool holders which hold the individual plane tools can sequentially and successively win minerals from the same winning face. Each planer is set or positioned at a different angle to make a different depth cut into the winning face.

In accordance with the inventive structure having separate planers assembled into a train, a repartition of the winning work to the individual planers is obtained. The planing tools are so arranged or adjustable relative to the working face that the individual planers work so to speak as plowshares, on the principle of broaching. According to this principle, the planing tools of the individual planers attack the face one after the other, with the manner and volume of the apportioned winning work being determined by the design and arrangement of the planing tools.

Due to the depth of cut, which is stepped up from planer to planer, the individual planers assembled into a train are capable of extracting a higher volume. Since the overall height of the individual planers is small, the tilting moments resulting from the thrust against the face are so reduced that the planer guide is not overstressed. Also, a relatively bigger mass of the individual planers is available for absorbing the cutting pressure, than with an integral planing mechanism. Further, the guidance of the planing mechanism is distributed to the individual planers and thus to more bases. A higher restoring moment opposing the tilting moment therefrom as compared to prior art designs. Finally, due to the hinge connections between the individual planers, the planer train is capable of traveling through elevations and depressions. The clearance of motion in the hinge connections allows the subsequent planer to ram the preceding one in the event that the latter has been stopped in its advance. Thereby the preceding individual planer is knocked loose and the train can continue traveling.

There are further features which are important to the invention. The planer train may be assembled of two or more individual planers of equal heights. Such a train is suitable especially for thin seams when a minimum space is available between the roof and the planer guide and, in spite of that, an increased output is required. It is also possible, however, to provide three individual planers in a train and to design the intermediate one as a tower planer, provided that the seam is sufficiently thick. In such a case, a correspondingly small depth of cut will be adjusted on the tower planer as compared to the other two individual planers. Also, in the upper part of the tower planer, a smaller number of planing tools may be provided since the purpose of these tools is essentially only to dislodge the coal from the upper zone of the seam and let it fall, where its structure is partly disintegrated by the roof pressure.

In accordance with the invention each planer is individually i.e., separately secured to the planer chain, while the hinge connections between the individual planers have a clearance of motion within an oblong slot. Therefore, the pull and load acting on the entire assembly are distributed to the individual planers, with a ramming play being preserved. Advantageously, the planer chain acts on the forward part of its planer, considered in the travel direction of the assembly. Another object of the invention is to provide a coal planer as disclosed above wherein the hinge connection comprises rigid connecting lugs extending from each of the planers and are movable in a vertical plane which are interconnected by a hinge bolt extending substantially perpendicular to the direction of travel of the planer.

Another object is to provide such a device wherein engagement between connecting lugs of adjacent planers permits relative movement also horizontally. If a preceding planer gets blocked, the mass of the subsequent planer or planers acts as a ram and knocks it loose. Also, the rotational moments acting in the zone of the hinge connections in a vertical or horizontal plane substantially compensate each other. Therefore, the individual planers combined with each other form a planer system in which the moments are equilibrated and which can be guided through elevations and depressions due to the capability of the individual planers to move at an angle relative to each other in a vertical plane.

A still further object of the invention is to provide such a device wherein, in the area of the hinge connections between individual planers, the planers are equipped with horizontal and vertical guide rollers, the vertical guide roller being mounted on the connecting bolt for the connecting lugs, and the guide rollers rolling on tracks provided on the planer guide.

Basically, the individual planers of the inventive planing mechanism or coal planer may be equipped each with portal-type backing supports at the waste side, for example in instances where the assembly is used in particularly thick seams or beds, so that the corresponding height of the individual planers calls for such a support with guide rollers to take up the tilting moments resulting from the necessary thrust. For this purpose, the invention provides that the portal-type supports of the individual planers are connected to each other by spring elements, to stabilize them in their upper parts and to be able to determine the depth of cut from planer to planer accurately, and also to obtain a coupling, even if limited, in addition to that provided by the hinge connections.

According to the invention, the spring elements are fixed to one of the portal-type supports and connected to the other supports with a horizontal clearance of motion in the travel direction, to make the assembly, in this embodiment also, capable of traveling through depressions and elevations, and even horizontal curves. With three individual planers forming the train, the spring elements are advantageously fixed to the intermediate planer. In any case, the spring elements may be combined into a leaf spring assembly or more such banks, so as to ensure that the preset depths of cut in succession are exactly observed.

Substantially, the invention offers the advantage of providing a planer assembly of the above mentioned kind having an increased working capacity even though its overall height is reduced, which is due to the use of individual planers, which are connected to each other. The inventive planer assembly can operate with a greater total depth of cut which, however, in accordance with the principle of broaching, can so be distributed to the tools of the individual planers that their individual cutting depths are relatively small. The result is that, insofar as no backing through portal-type supports is necessary, the planer guide is suitable for absorbing the tilting moments caused by the thrust forces. Consequently, the inventive coal planer can preferably be used in thin seams.

It can also be used in thick seams, but only with portal-type backing supports, to obtain a sufficient depth of cut. In any case, the invention teaches that the winning work is apportioned to two or more individual planers or plows so that the output can be increased with a conventional planer guidance.

Another object of the invention is to provide a planer mechanism for a winning machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the Drawings:

FIG. 1 is a diagrammatical elevational side view of an inventive coal planer assembly with two individual planers combined into a train according to the invention;

FIG. 1*a* is an enlarged detail of FIG. 1;

FIG. 2 is a top plan view of the device shown in FIG. 1;

FIG. 2*a* is an enlarged detail of FIG. 2;

DESCRIPTION OF THE PREFERRED EMBODIMENTS

The figures show a planer assembly for winning minerals, and more specifically a coal planer assembly for underground work.

Figure 3:
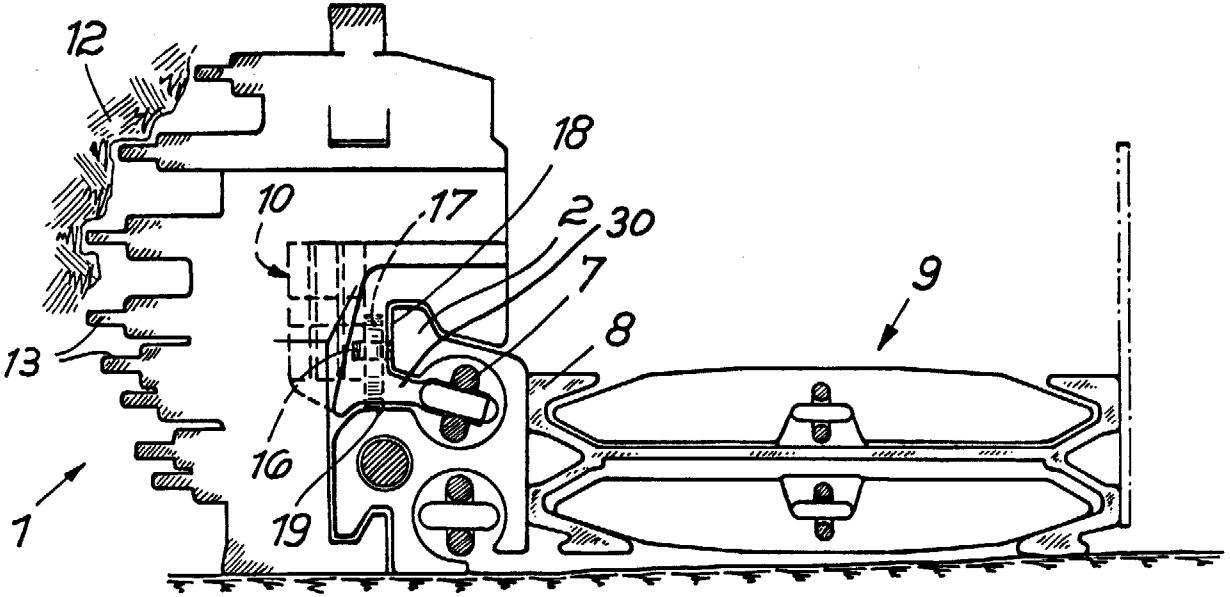
FIG. 3 is a front view in the travel direction of the device shown in FIG. 1.

The assembly generally designated 1 in FIG. 1, comprises three planers 3,4,5 (5 not shown in FIG. 1) each equipped with at least one tool holder 6 and moving on a common planer guide 2 by means of a planer chain 7 (FIG. 3) running in guide 2 and secured to the individual planers 3,4,5 over connecters 30, one of which is shown in FIG. 3. Planer guide 2 in turn is secured to the side wall of a single-chain scraper conveyor 9. The assembly is designed as a train of planers, made up of two or more individual planers 3,4,5 which are connected to each other by hinge connections 10.

The tool holders 6 of the individual planers 3,4,5 are so arranged or, as in the present example, pivotable about vertical axes 11, so as to be adjustable in position relative to the winning face 12, so that the depths of cut, $T_1$, $T_2$ and $T_3$, of planer tools 13 carried on holders 6, grow larger from planer 3 to planer 4 or 5, i.e. in the direction opposite to the travel direction, so as to finally obtain a predetermined total depth $T_3$. The setting or adjustment of the individual planers is in accordance with known techniques. The total depth of extraction is thus distributed to the tools 13 of the individual planers 3, 4,5 in accordance with the principle of broaching.

In the shown example, the planer train is made of two individual planers 3, 4 or equal height, but it may also comprise more, for example, three individual planers 3,4,5 of which the intermediate one is designed as a tower planer shown by the chain line at 6' in FIG. 1) which is taller than the other two. The tower planer 6' has an upper tool 13' which is narrower than the other tools 13. Each planer, 3, 4 is secured to the planer chain individually, at its forward end, considered in the travel direction. The hinge connections 10 include connecting lugs 14 rigidly secured to the individual planers 3,4 which interengage and are connected to each other by a transversely extending hinge bolt 15 so that they can move at an angle in a vertical plane.

In the zone of interengagement, connecting lugs 14 have a predetermined horizontal clearance of motion S. The center lug 14 in FIG. 2*a* is also shaped to permit movement in a horizontal plane. Due to this clearance, a ramming effect is obtained at instances where the travel of a preceding planer 3 should abruptly be blocked. This happens for example if the preceding individually planer 3 gets jammed in the winning face 12 or encounters an increased resistance.

At this point the subsequent individual planers 4,5 advance one after the other, through the predetermined clearance of motion S to ram each other and the preceding one and knock it loose by the imparted kinetic energy. Thereafter, the clearance of motion S between the individual planers 3,4,5 reestablishes automatically so that, if necessary, a new ramming effect can be obtained. For this reason, the feature of a horizontal clearance of motion S between the individual planers 3,4,5 is important in itself.

In the zone of hinge connections 10 the individual planers 3,4,5 are provided each with horizontal guide rollers 16 and with a common vertical guide roller 17 which is carried by hing bolt 15. The rollers run on track surfaces 18, 19 provided on planer guide 2 and serve as an additional support of the individual planers 3,4.

Figure 4:
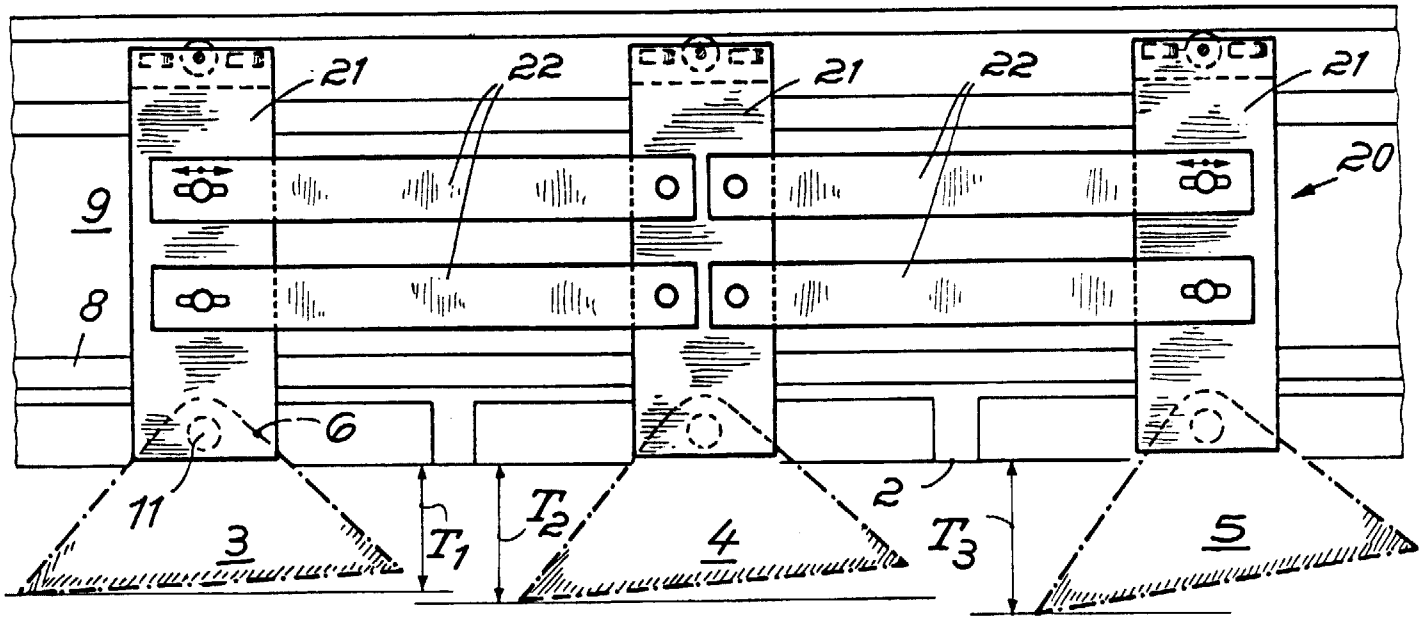
FIG. 4 shows a modified design corresponding to FIG. 2 with portal-type backing supports.
Figure 5:
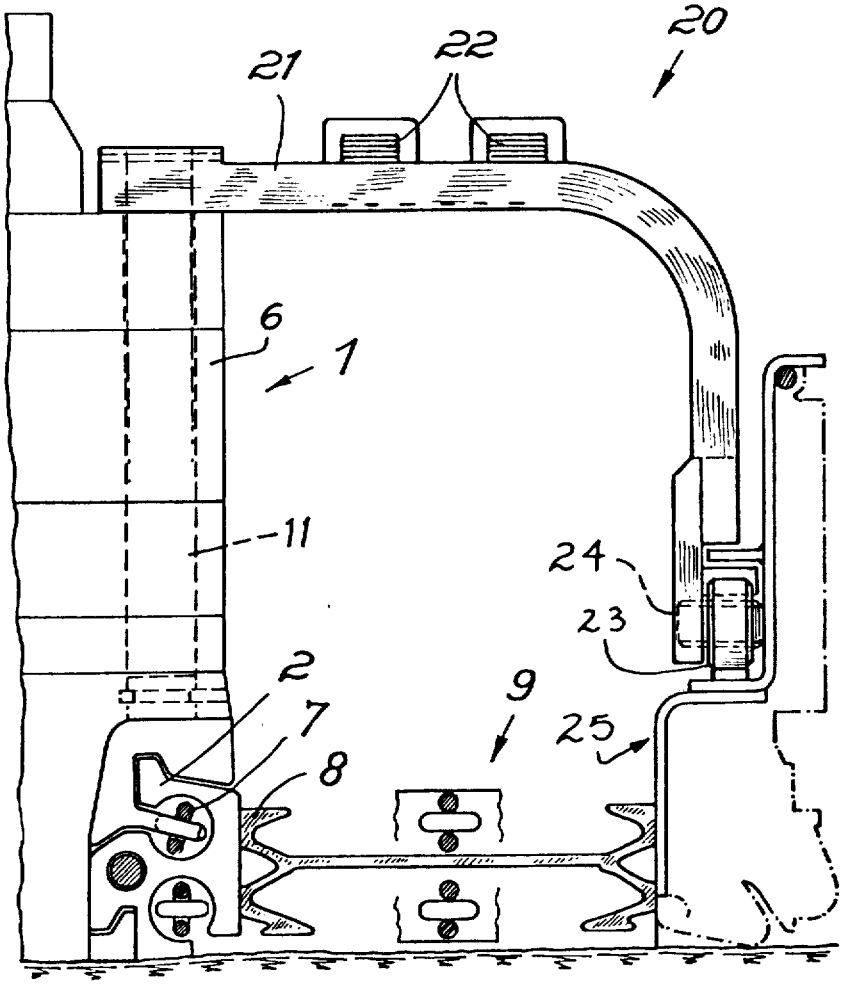
FIG. 5 is a front view of the device shown in FIG. 4.

In the modified embodiment of FIGS. 4 and 5 the individual planers 3,4,5 are equipped with portal-type backing supports 20 at the waste side. Such a support 20 is advisable particularly if the individual planers are high. The pivot pin 11 for the holder 6 of this embodiment is mounted at the top in support 20, and at the bottom in guide member 2. With this design, the backing supports of the individual planers 3, 4, 5 are connected to each other by spring elements 22. Spring elements 22 are fixed to one of the supports and connected to the other supports with a horizontal clearance of motion in the travel direction. In the shown example of three individual planers 3,4,5 combined to form a train, spring elements 22 are fixed to support 21 of the intermediate planer 4 and they are designed as one or more banks of leaf springs. Support 20 rides on vertical and horizontal rollers 23, 24, on the track surfaces of a guide rail member 25 connected to the waste side of conveyor 9.

While specific embodiments of the invention have been shown and described in detail to illustrate the application of the principles of the invention, it will be understood that the invention may be embodied otherwise without departing from such principles.

What is claimed is:

1. A planer assembly for winning minerals from a mineral face comprising:
- a planer guide member;
- at least two planers engaged with said guide member and slidable therealong in a travel direction;
- hinge means interconnecting said at least two planers for transferring moments applied to each of said planers; and
- a planer tool holder for holding at least one planer tool mounted on each of said planers and positioned to make a cut in the mineral face of a selected depth, the depth increasing from planer to planer in a direction opposite the travel direction;
- said hinge means comprising a connecting lug rigidly connected to each of said planers and extending outwardly therefrom, a hinge bolt extending substantially perpendicular to the travel direction and through connecting lugs of adjacent planers for interconnecting said adjacent planers for permitting relative movement at an angle in a vertical plane of adjacent planers.

2. A planer assembly according to claim 1, wherein the height of each of said at least two planers is substantially equal.

3. A planer assembly according to claim 1, including at least one additional planer connected to said at least two planers, hinge means interconnecting said at least one additional planer, an intermediate one of said planers comprising a tower planer having a height higher than two flanking planers.

4. A planer assembly according to claim 3, wherein each of said planers includes a planer tool holder mounted thereon having a plurality of planer tools, an upper planer tool of said tower planer being narrower than other planer tools of said planers.

5. A planer assembly according to claim 1, including a planer chain movably mounted in said guide member, each of said planers connected individually to said planer chain for movement of each individual planer.

6. A planer assembly according to claim 5, wherein each of said planers is connected to said planer chain at a front end of each planer in the travel direction.

7. A planer assembly according to claim 1, wherein said connecting lugs are shaped to permit movement of adjacent planers at an angle to each other in a horizontal plane.

8. A planer assembly according to claim 7, wherein each of said connecting lugs includes an elongated opening therethrough, said hinge bolt extending through said elongated opening for permitting relative angular movement between adjacent planers in a horizontal plane.

9. A planer assembly for winning minerals from a mineral face comprising:
- a planer guide member;
- at least two planers engaged with said guide member and slidable therealong in a travel direction;
- hinge means interconnecting said at least two planers for transferring moments applied to each of said planers; and
- a planer tool holder for holding at least one planer tool mounted on each of said planers and positioned to make a cut in the mineral face of a selected depth, the depth increasing from planer to planer in a direction opposite the travel direction;
- each of said planers including at least one rotatably mounted horizontal roller and at least one rotatably mounted vertical roller, said guide member having vertical and horizontal tracks on which said horizontal and vertical rollers roll to guide the movement of said planers.

10. A planer assembly according to claim 9, wherein said hinge means comprises a fixed lug extending from each of said planers and a hinge bolt extending through said fixed lugs for permitting relative angular movement between adjacent planers in a vertical plane, said at least one vertical roller rotatably mounted on said hinge bolt.

11. A planer assembly for winning minerals from a mineral face comprising:
- a planer guide member;
- at least two planers engaged with said guide member and slidable therealong in a travel direction;
- hinge means interconnecting said at least two planers for transferring moments applied to each of said planers; and
- a planer tool holder for holding at least one planer tool mounted on each of said planers and positioned $t_o$ make a cut in the mineral face of a selected depth, the depth increasing from planer to planer in a direction opposite the travel direction;
- a backing support member connected to each of said planers for supporting said planers while moving in the travel direction, and spring means interconnecting each one of said backing support members.

12. A planer assembly according to claim 11, wherein said spring means comprises at least one spring element connected for limited relative movement to at least one of said planers in a horizontal plane parallel to said travel direction.

13. A planer assembly according to claim 12, including at least three planers each having a backing support member, an intermediate one of said backing support members being rigidly connected to said spring element and flanking support members being connected with limited horizontal relative movement.

14. A planer assembly according to claim 13, wherein each of said spring elements comprises a plurality of leaf springs.

15. A planer assembly according to claim 14, including a conveyor for extension along the mineral face connected to said guide member, one additional guide member connected to said conveyor on a side thereof opposite said formerly mentioned guide member, each backing support member including at least one rotatably mounted horizontal roller and at least one rotatably mounted vertical roller, said additional guide member having vertical and horizontal tracks on which said horizontal and vertical rollers roll.

16. A planer assembly according to claim 15, wherein each planer tool holder is pivotally mounted at its bottom on said guide member and at its top on said backing support member.

17. A planer assembly for winning minerals from a winning face, comprising a planing mechanism including at least one tool holder, and a planer chain running in a planer guide to which the planing mechanism is connected, the planing mechanism comprising a train of at least two individual planers which, with interposed hinge connections to compensate for occurring moments, are rigidly connected to each other to move at the same level from the winning face, so that tool holders of the individual planers are so positionable, relative to the winning face that the depth of cut $T_1$, $T_2$, $T_3$ at corresponding levels of the planer tools supported on the tool holder increases from one of said planer to another of said planer in the direction opposite to the travel direction of the assembly, each planer carrying a single tool holder which is pivotable about a vertical axis and which is pivotable against the winning face to obtain the depths of cut $T_1$, $T_2$, $T_3$.

18. A planer assembly according to claim 17, wherein the train of planers comprises two or more individual planers of equal height.

19. A planer assembly according to claim 17 wherein the train of planers comprises three individual planers of which an intermediate one is designed as a tower planer.

20. A planer assembly according to claim 19, wherein each individual planer is secured to a planer chain of the assembly, separately.

21. A planer assembly according to claim 20, wherein the planer chain acts on each planer at the forward end thereof.

22. A planer assembly according to claim 17, wherein the hinge connections comprise interengaging, rigidly secured connecting lugs which can angle relative to each other in a vertical plane, about a hinge bolt extending perpendicularly to the planer travel direction.

23. A planer assembly according to claim 22, wherein the range of engagement of the connecting lugs, the hinge connections have a predetermined, horizontal clearance of motion.

24. A planer assembly according to claim 22, wherein in the zone of the hinge connections the individual planers are equipped each with horizontal guide rollers and with a common vertical guide roller which is carried by the hinge bolt, and that the guide rollers run on track surfaces which are provided on the planer guide.

25. A planer assembly according to claim 17, including a portal type backing support for each of the planers, the backing supports of the individual planers being connected to each other by spring elements.

26. A planer assembly according to claim 25, wherein the spring elements are fixed to one of the backing supports and connected to the other backing supports with a horizontal clearance of motion in the planer travel direction.

27. A planer assembly according to claim 25, including three individual planers forming the train, the spring elements being fixed to the backing support of an intermediate individual planer.

28. A planer assembly according to claim 25, wherein the spring elements are assemblies of at least one leaf spring bank.

* * * * *